US008327941B2

(12) United States Patent
Hackworth et al.

(10) Patent No.: US 8,327,941 B2
(45) **Date of Patent: *Dec. 11, 2012**

(54) FLOW CONTROL DEVICE AND METHOD FOR A DOWNHOLE OIL-WATER SEPARATOR

(75) Inventors: Matthew R. Hackworth, Manvel, TX (US); Nihat Ovutmen, Sugar Land, TX (US); Kevin J. Forbes, Houston, TX (US); Lance I. Fielder, Sugar Land, TX (US); Allan Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/880,573

(22) Filed: Sep. 13, 2010

(65) Prior Publication Data

US 2011/0000675 A1 Jan. 6, 2011

Related U.S. Application Data

(63) Continuation of application No. 11/953,970, filed on Dec. 11, 2007, now Pat. No. 7,814,976.

(51) Int. Cl.
*E21B 34/00* (2006.01)
*E21B 43/00* (2006.01)

(52) U.S. Cl. ..... 166/316; 166/339; 166/357; 166/265; 166/386

(58) Field of Classification Search ..... 166/265, 166/386; 210/512.1
See application file for complete search history.

(56) References Cited

U.S. PATENT DOCUMENTS

| | | | | | |
|---|---|---|---|---|---|
| 2,246,811 | A | * | 6/1941 | Otis | 417/109 |
| 2,658,457 | A | * | 11/1953 | Harbison | 166/105.2 |
| 2,822,048 | A | | 2/1958 | Tausch | |
| 3,359,740 | A | | 12/1967 | Cochrane | |
| 3,410,217 | A | * | 11/1968 | Kelley et al. | 417/58 |
| 3,559,740 | A | * | 2/1971 | Scaggs | 166/313 |
| RE28,588 | E | | 10/1975 | Sizer et al. | |
| 4,738,313 | A | | 4/1988 | McKee | |
| 4,738,779 | A | * | 4/1988 | Carroll et al. | 210/512.2 |
| 4,937,946 | A | | 7/1990 | Steinhoff | |
| 5,150,619 | A | | 9/1992 | Turner et al. | |
| 5,693,225 | A | * | 12/1997 | Lee | 210/512.2 |
| 5,730,871 | A | | 3/1998 | Kennedy et al. | |
| 5,830,368 | A | * | 11/1998 | Peachey | 210/747 |
| 5,937,946 | A | | 8/1999 | Streetman | |
| 5,961,841 | A | * | 10/1999 | Bowers | 210/739 |

(Continued)

FOREIGN PATENT DOCUMENTS

CA 2428056 A1 10/1995

(Continued)

OTHER PUBLICATIONS

GC Search and Exam Report dated Sep. 21, 2011 for corresponding GC Application No. GCC/P/2008/11609 filed Aug. 27, 2008.

*Primary Examiner* — Matthew Buck
(74) *Attorney, Agent, or Firm* — Jim Patterson

(57) ABSTRACT

A downhole device having an oil/water separator having a well fluid inlet, an oil stream outlet conduit, and a water stream outlet conduit; a removable flow-restrictor located in at least one of the water stream outlet conduit or the oil stream outlet conduit.

17 Claims, 7 Drawing Sheets

U.S. PATENT DOCUMENTS

| | | | | |
|---|---|---|---|---|
| 5,971,004 | A | 10/1999 | Pringle | |
| 5,996,690 | A | 12/1999 | Shaw et al. | |
| 6,017,456 | A | 1/2000 | Kennedy et al. | |
| 6,033,567 | A | 3/2000 | Lee et al. | |
| 6,068,053 | A | 5/2000 | Shaw | |
| 6,070,661 | A * | 6/2000 | Kennedy et al. | 166/106 |
| 6,082,452 | A * | 7/2000 | Shaw et al. | 166/105.5 |
| 6,138,758 | A * | 10/2000 | Shaw et al. | 166/265 |
| 6,158,714 | A | 12/2000 | Lembcke et al. | |
| 6,189,613 | B1 * | 2/2001 | Chachula et al. | 166/265 |
| 6,196,312 | B1 | 3/2001 | Collins et al. | |
| 6,277,286 | B1 * | 8/2001 | Søntvedt et al. | 166/250.03 |
| 6,336,503 | B1 * | 1/2002 | Alhanati et al. | 166/265 |
| 6,336,504 | B1 * | 1/2002 | Alhanati et al. | 166/265 |
| 6,357,525 | B1 | 3/2002 | Langseth et al. | |
| 6,367,547 | B1 * | 4/2002 | Towers et al. | 166/265 |
| 6,394,183 | B1 | 5/2002 | Schrenkel et al. | |
| 6,397,547 | B1 | 6/2002 | Martensson | |
| 6,547,005 | B2 * | 4/2003 | Haheim | 166/265 |
| 6,659,184 | B1 | 12/2003 | Tips et al. | |
| 6,719,048 | B1 * | 4/2004 | Ramos et al. | 166/250.15 |
| 6,732,801 | B2 | 5/2004 | Ohmer et al. | |
| 6,755,978 | B2 | 6/2004 | Oddie | |
| 6,761,215 | B2 * | 7/2004 | Morrison et al. | 166/105.5 |
| 6,786,285 | B2 | 9/2004 | Johnson et al. | |
| 6,881,329 | B2 | 4/2005 | Amado et al. | |
| 6,883,613 | B2 | 4/2005 | Bode et al. | |
| 6,989,103 | B2 | 1/2006 | Mohsen et al. | |
| 6,993,432 | B2 | 1/2006 | Jenkins et al. | |
| 7,055,598 | B2 | 6/2006 | Ross et al. | |
| 7,059,401 | B2 | 6/2006 | Bode et al. | |
| 7,164,990 | B2 | 1/2007 | Bratvedt et al. | |
| 7,314,559 | B2 | 1/2008 | Hopper | |
| 7,814,976 | B2 | 10/2010 | Hackworth et al. | |
| 8,006,757 | B2 | 8/2011 | Hackworth et al. | |
| 2001/0007283 | A1 * | 7/2001 | Johal et al. | 166/265 |
| 2001/0017207 | A1 * | 8/2001 | Haheim | 166/265 |
| 2002/0023750 | A1 * | 2/2002 | Lopes et al. | 166/265 |
| 2002/0059866 | A1 | 5/2002 | Grant et al. | |
| 2002/0134554 | A1 * | 9/2002 | Schrenkel et al. | 166/372 |
| 2002/0195250 | A1 | 12/2002 | Underdown et al. | |
| 2004/0045708 | A1 * | 3/2004 | Morrison et al. | 166/265 |
| 2005/0034875 | A1 | 2/2005 | McLoughlin et al. | |
| 2005/0087336 | A1 * | 4/2005 | Surjaatmadja et al. | 166/105.5 |
| 2005/0236324 | A1 | 10/2005 | Mildren et al. | |
| 2006/0037746 | A1 * | 2/2006 | Wright et al. | 166/265 |
| 2006/0175052 | A1 | 8/2006 | Tips | |
| 2007/0078703 | A1 | 4/2007 | Shipley et al. | |
| 2008/0236821 | A1 | 10/2008 | Fielder | |
| 2009/0065431 | A1 * | 3/2009 | Bakke et al. | 210/512.1 |
| 2010/0096142 | A1 * | 4/2010 | Randazzo | 166/373 |

FOREIGN PATENT DOCUMENTS

| | | | |
|---|---|---|---|
| EP | 1279795 | A1 | 1/2003 |
| GB | 2369631 | A | 6/2002 |
| RU | 2290505 | C1 | 12/2006 |
| WO | 97/08459 | A1 | 3/1997 |
| WO | 01/31167 | A1 | 5/2001 |
| WO | 01/65064 | A1 | 9/2001 |
| WO | 2006/032141 | A1 | 3/2006 |
| WO | 2006/067151 | A1 | 6/2006 |

* cited by examiner

FLOW CONTROL DEVICE AND METHOD FOR A DOWNHOLE OIL-WATER SEPARATOR

This application is a continuation of U.S. application Ser. No. 11/953,970 filed on Dec. 11, 2007, incorporated by referenced in its entirety.

TECHNICAL FIELD

The present application relates generally to the field of artificial lifts, and more specifically to artificial lifts in connection with hydrocarbon wells, and more specifically, associated downhole oil/water separation methods and devices.

BACKGROUND

Oil well production can involve pumping a well fluid that is part oil and part water, i.e., an oil/water mixture. As an oil well becomes depleted of oil, a greater percentage of water is present and subsequently produced to the surface. The "produced" water often accounts for at least 80 to 90 percent of a total produced well fluid volume, thereby creating significant operational issues. For example, the produced water may require treatment and/or re-injection into a subterranean reservoir in order to dispose of the water and to help maintain reservoir pressure. Also, treating and disposing produced water can become quite costly.

One way to address those issues is through employment of a downhole device to separate oil/water and re-inject the separated water, thereby minimizing production of unwanted water to surface. Reducing water produced to surface can allow reduction of required pump power, reduction of hydraulic losses, and simplification of surface equipment. Further, many of the costs associated with water treatment are reduced or eliminated.

However, successfully separating oil/water downhole and re-injecting the water is a relatively involved and sensitive process with many variables and factors that affect the efficiency and feasibility of such an operation. For example, the oil/water ratio can vary from well to well and can change significantly over the life of the well. Further, over time the required injection pressure for the separated water can tend to increase.

Given that, the present application discloses a number of embodiments relating to those issues.

SUMMARY

An embodiment is directed to a downhole device comprising an electric submersible motor; a pump connected with the electric submersible motor, the pump having an intake and an outlet; the electric submersible motor and the pump extending together in a longitudinal direction; an oil/water separating device having an inlet in fluid communication with the pump outlet and having a first outlet and a second outlet, the first outlet connecting with a first conduit and the second outlet connecting with a second conduit; a redirector integrated with the first conduit and the second conduit, the redirector having a flow-restrictor pocket that extends in the longitudinal direction, a downhole end of the flow-restrictor pocket connecting with a re-injection conduit; the first conduit extending uphole to a level of the flow-restrictor pocket, and the second conduit extending farther uphole than the first conduit; the uphole end of the flow-restrictor pocket connecting with the second conduit; and a passage connecting the first conduit with the flow-restrictor pocket.

DETAILED DESCRIPTION

In the following description, numerous details are set forth to provide an understanding of the present invention. However, those skilled in the art will understand that the present invention may be practiced without many of these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

The present application relates to downhole oil/water separation, and more particularly, advantageously managing back-pressure to manipulate the oil/water separation. One way to advantageously control separation of fluids is by regulating back-pressure applied to the oil stream and/or the water stream. One way to regulate back-pressure is by regulating a flow-restriction (i.e., throttling) of the oil stream and/or the water stream exiting the oil/water separator. Embodiments herein relate to equipment that allows a stream to be throttled, i.e., a back-pressure to be manipulated. The magnitude of a throttling can cover a range from completely closed to wide open depending on the oil/water content of the well fluid.

The form and function controlling backpressure and related flow is highly dependent upon the injection zone orientation relative to the producing zone (injection zone uphole or downhole of the producing zone). Some key differences between the two orientations relate to injecting uphole where the device can throttle and vent to a tubing annulus in a single operation, and injecting downhole where the device may need to throttle the flow "in-line", i.e. receive the injection flow from the tubing, throttle the flow, and then return the flow to another tube headed toward the injection zone. Some or all of these factors can be considered. The diameter of a throttle opening can generally be from 0.125 to 1.0 inches.

Figure 1:
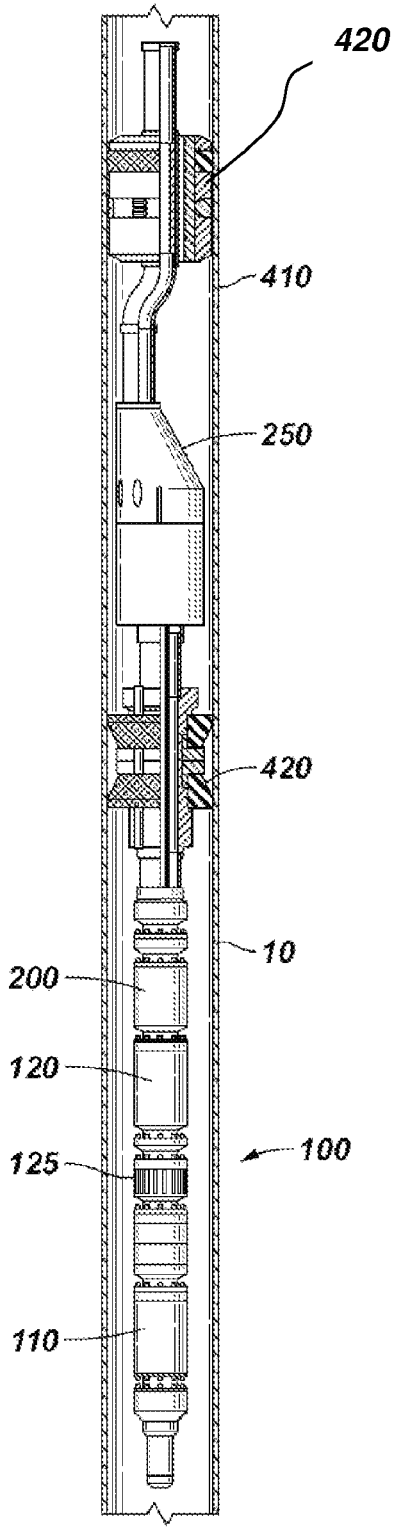
FIG. 1 shows a configuration of an embodiment.

FIG. 1 shows an overall schematic for an embodiment of a device. Some of the main components of the device are an ESP 100 comprising a motor 110 and a pump 120. A centrifugal or cyclone oil/water separator 200 is connected adjacent to the pump 120. The apparatus is placed downhole in a hydrocarbon well, preferably inside a well casing 10. The motor 110 drives the pump 120. The motor 110 also drives the oil/water separator 200. During operation, well fluid is drawn into the pump 120 through a vent 125. The oil/water mixture is driven out of the pump 120 and into the oil/water separator 200, a centrifugal type separator in this case. The oil/water separator 200 accelerates and drives the oil/water mixture in a circular path, thereby utilizing centrifugal forces to locate more dense fluids (e.g., water) to a farther out radial position and less dense fluids (e.g., oil) to a position nearer to the center of rotation. An oil stream and a water stream exit the oil/water separator 200 and travel separately along different paths to a redirector 250, where the water stream is redirected and re-injected into formation while the oil stream is directed uphole to surface.

Figure 2:
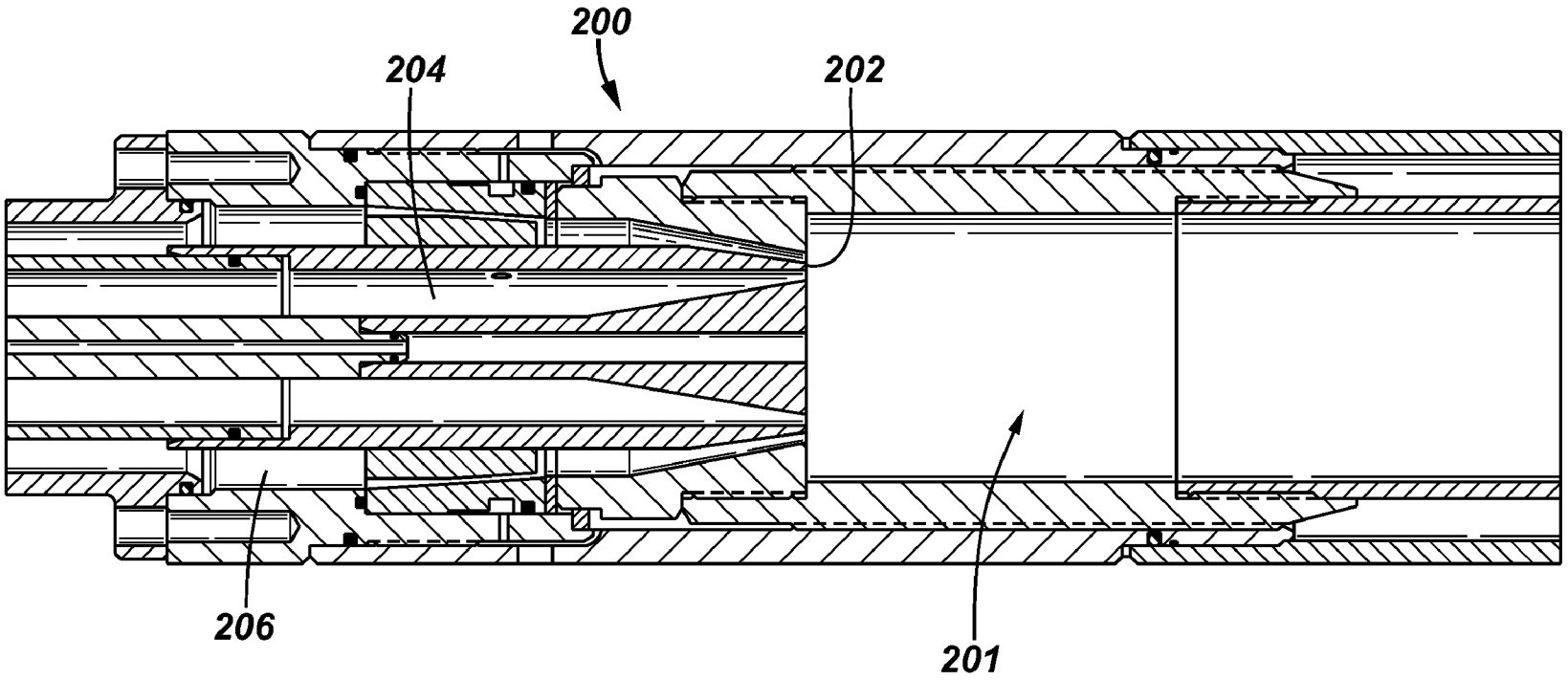
FIG. 2 shows a portion of a cross section of an embodiment.

FIG. 2 shows a cut away view of the oil/water separator 200, which is of the centrifugal type. A well fluid mixture is driven into and rotated in a cyclone chamber 201 of the oil/water separator 200. The layers of the stream are separated by a divider 202 that defines a beginning of an oil conduit 204 and a beginning of a water conduit 206. The oil conduit 204 is further inward in a radial direction with respect to the water conduit 206. Back-pressure of the streams affects the oil/water separation process. For example, for well fluids having a high percentage of oil, higher back-pressure for the water stream 206 can improve separation results. Similarly, for well fluids having a higher percentage of water, a higher back-pressure for the oil stream 204 can improve oil/water separation. Essentially the same back-pressure principal applies to cyclone type oil/water separators.

Figure 3:
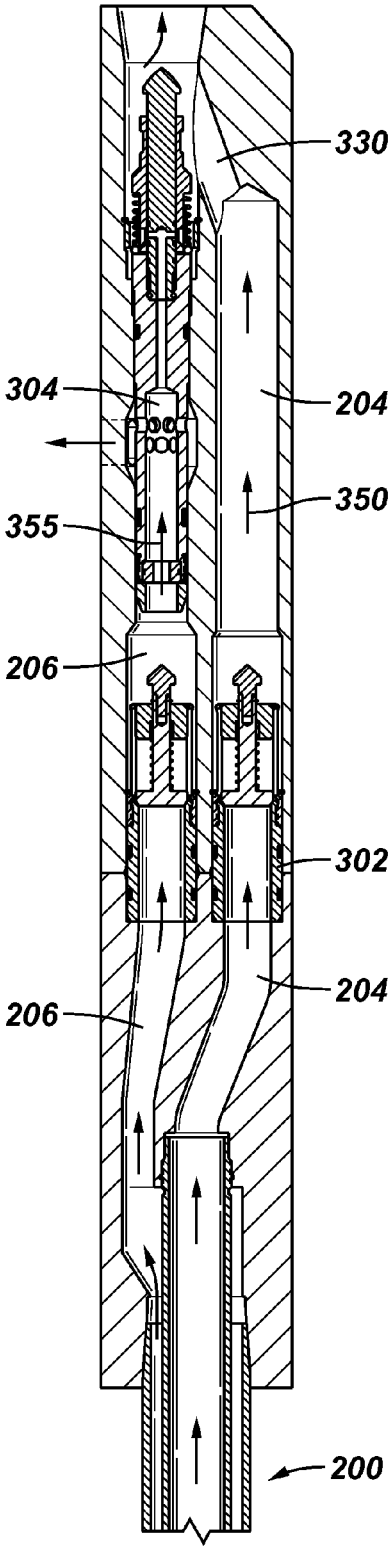
FIG. 3 shows a portion of a cross section of an embodiment.

FIG. 3 shows another sectional view of the oil/water separator 200 having the oil conduit 204 and the water conduit 206. Passage 330 (in FIGS. 3 and 4) connects with oil conduit 204. Arrows 350 show a representative path of the oil stream. Arrows 355 show a representative path of the water stream. A flow-restrictor 304, e.g., a throttle, is in the water conduit 206. The water stream flows uphole into the flow-restrictor 304. The flow-restrictor 304 could be located in the oil conduit 204. One flow-restrictor 304 could be in the water conduit 206 and another flow-restrictor 304 could be in the oil conduit 204 simultaneously. Selection of a flow-restrictor 304 from a number of different flow-restrictors having different variations of orifice size and configuration enables adjustment of the aforementioned backpres sure in the water stream 206. There are many ways to replace the flow-restrictor 304 with another different flow-restrictor 304 having a different throttle, thereby adjusting the backpressure situation. Preferably, a wireline tool can be lowered to place/remove a flow-restrictor 304. A flow-restrictor 304 can also be inserted and removed using slickline, coiled tubing, or any other applicable conveyance method. Slickline tends to be the most economical choice. In connection with use of a slickline, or coiled tubing for that matter, the oil stream channel is preferably positioned/configured to prevent tools lowered down by wireline, slickline or coiled tubing from inadvertently entering the oil conduit 204. The oil conduit 204 can be angled to prevent the tool from entering the oil conduit 204. The oil conduit 204 can further be sized such that the tool will not be accepted into the bore.

Alternately, the flow-restrictor 304 can have a variable size throttle orifice so that replacement of the flow-restrictor is not required to vary orifice size. The orifice size can be varied mechanically in many ways, e.g., at surface by hand, by a wireline tool, a slickline tool, a coil tubing tool, a hydraulic line from the surface, by an electric motor controlled by electrical signals from the surface or from wireless signals from the surface, or by an electrical motor receiving signals from a controller downhole.

Check valves 302 can be located in the oil conduit 204 and/or the water conduit 206. The check valves 302 can prevent fluid from moving from the oil conduit 204 and the water conduit 206 down into the oil/water separator 200, thereby causing damage to the device.

Packers can be used to isolate parts of the apparatus within the wellbore. For example, FIG. 1 shows packers 420 isolating an area where water is to be re-injected into the formation from an area where well fluid is drawn from the formation. The packer configuration effectively isolates the pump intake from re-injection fluid. Alternately, the packer 420 could be located below the pump 200, so long as the water is re-injected above the packer 410 or below the packer 420, thereby adequately isolating the area where the well fluids are produced from the area of the formation where water is re-injected. No specific packer configuration is required, so long as isolation between producing fluid and injecting fluid is adequately achieved.

Figure 4:
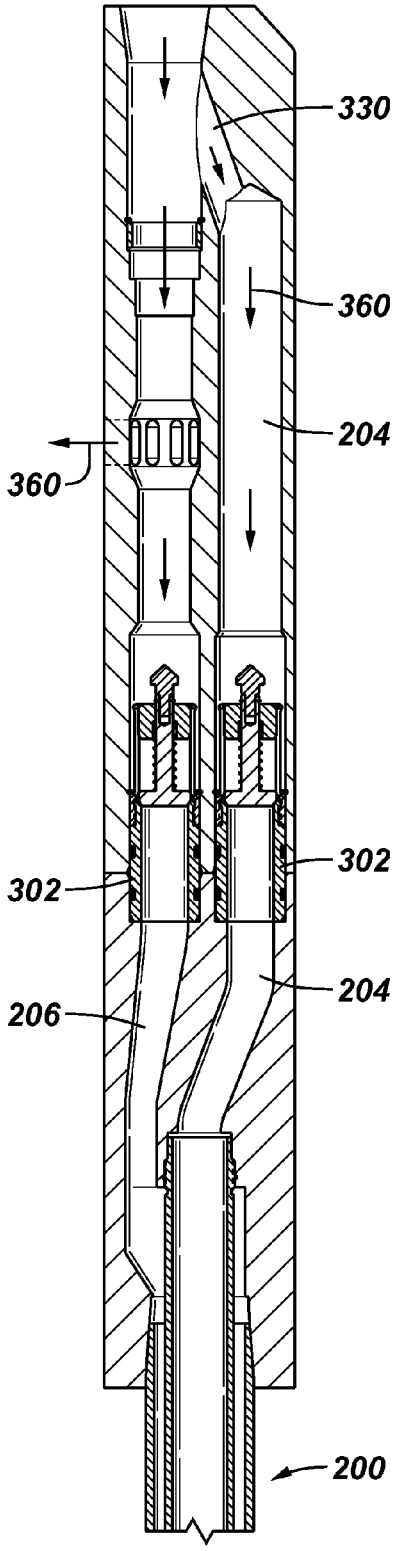
FIG. 4 shows a portion of a cross section of an embodiment.

The above noted configurations can also be used to inject stimulation treatments downhole. FIG. 4 shows the apparatus of FIG. 3 except with the flow-restrictor 304 removed. FIG. 4 shows pumping of stimulating treatments down the completion tubing and into both the oil conduit 204 and the water conduit 206. A flow-restrictor can be replaced with a flow device that prevents treatment fluid from following along the path of re-injection water. The arrows 360 illustrate a representative path of the stimulating treatment. The check valves 302 can prevent the stimulation fluid from traveling into the oil/water separation 200, thereby potentially causing detrimental effects.

Figure 5:
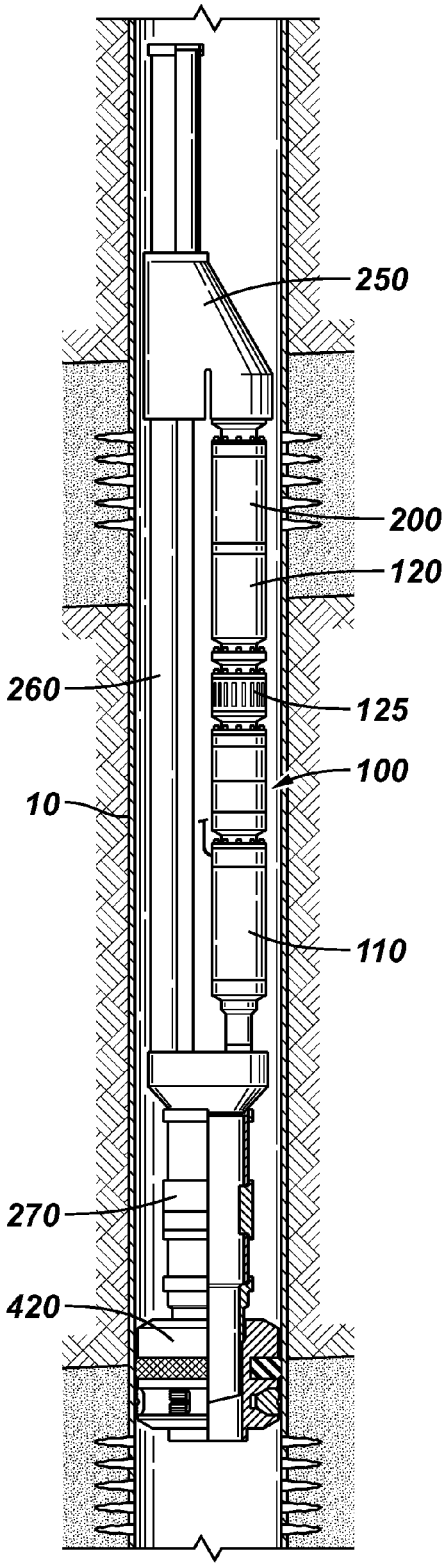
FIG. 5 shows a configuration of an embodiment.

FIG. 5 shows a configuration to re-inject a water stream to a zone located below the producing zone. A motor 110, a pump 120, and an oil/water separator 200 are connected as before. A redirector 250 is connected uphole from the oil/water separator 200. The redirector 250 is connected to a conduit 260 that extends downhole from the re-injection and through a packer 420. The packer 420 separates a production area that is uphole from the packer 420, from a re-injection area that is downhole from the packer 420. In that embodiment, the water stream travels through a tailpipe assembly 270. The tailpipe assembly 270 extends though the packer 420 into the re-injection area that is downhole from the packer 420.

Figure 6:
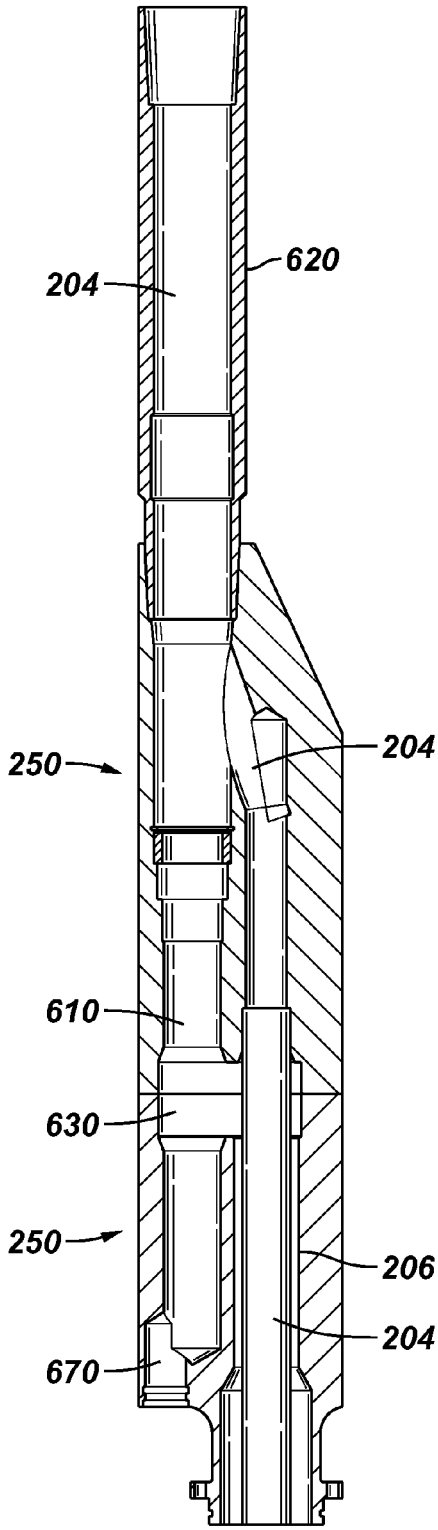
FIG. 6 shows a cross section of a portion of an embodiment.
Figure 9:
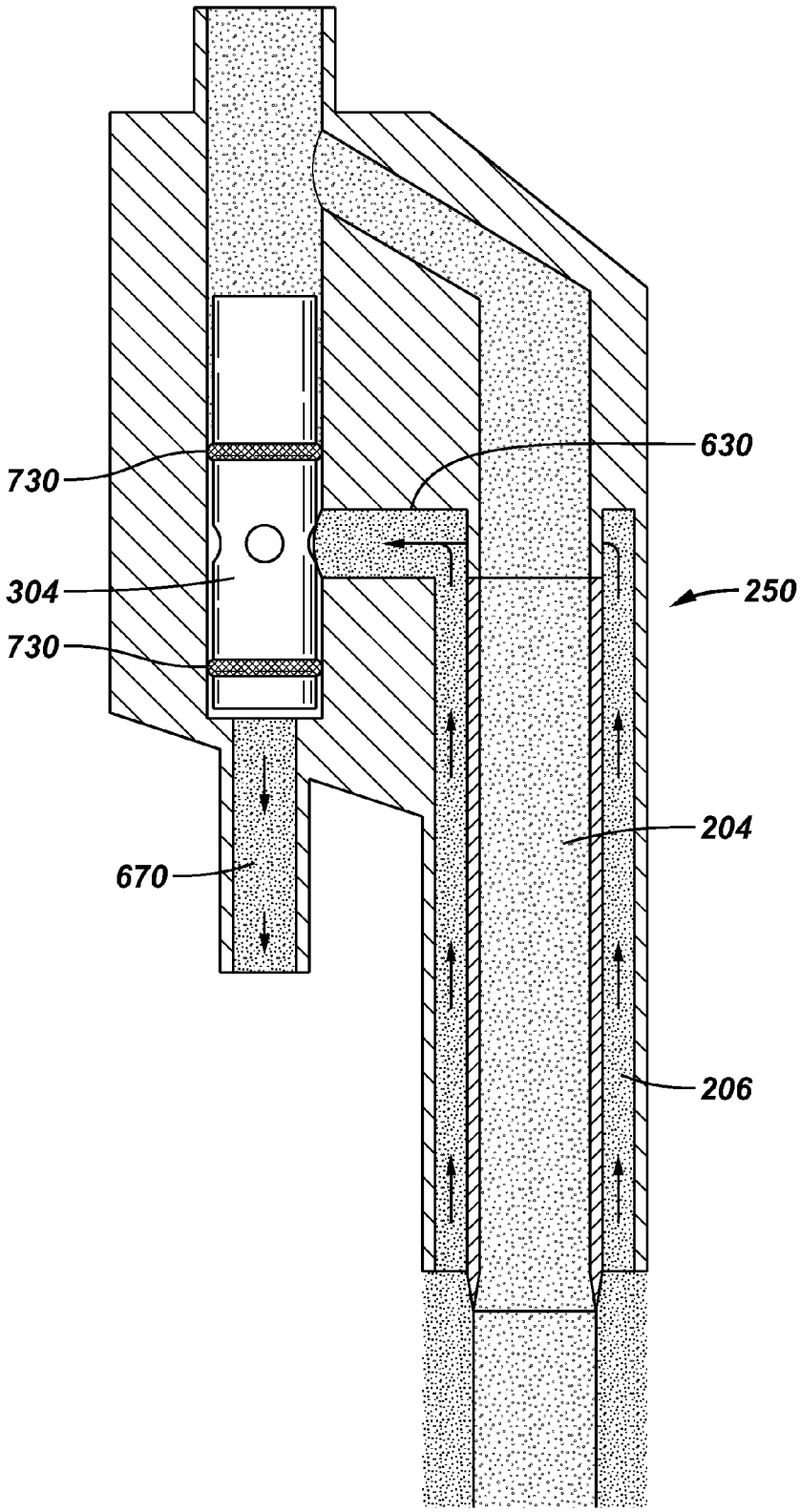
FIG. 9 shows a cross section of a portion of an embodiment in use.

FIG. 6 shows a more detailed cross section of an embodiment of the redirector 250. FIG. 9 shows a cross section of a redirector 250 and a flow-restrictor 304 in operation with the flow-restrictor 304 positioned in the flow-restrictor pocket 610. The flow-restrictor pocket 610 is configured to receive a flow-restrictor 304. The water conduit 206 is configured to be radially outside the oil conduit 204, i.e., a centrifugal oil/water separation. The oil conduit 204 extends from downhole of the redirector 250, through the redirector 250, and uphole past the redirector 250, where the oil conduit 204 connects with production tubing 620 (e.g., coil tubing). The water conduit 204 extends from below the redirector 250 and into the redirector 205. The water conduit 204 merges into a water passage 630 that connects the water conduit 204 with the flow-restrictor pocket 610. The water passage 630 can extend in a direction substantially perpendicular to the water conduit 204 proximate to the water passage. That is, during operation, the flow of the water makes approximately a 90 degree turn. The water can alternately make as little as approximately a 45 degree turn and as much as approximately a 135 degree turn. A re-injection passage 670 extends from the flow-restrictor pocket 610 downhole past the redirector 250. The re-injection passage 670 can be connected with completion tubing or other tubing.

Figure 7:
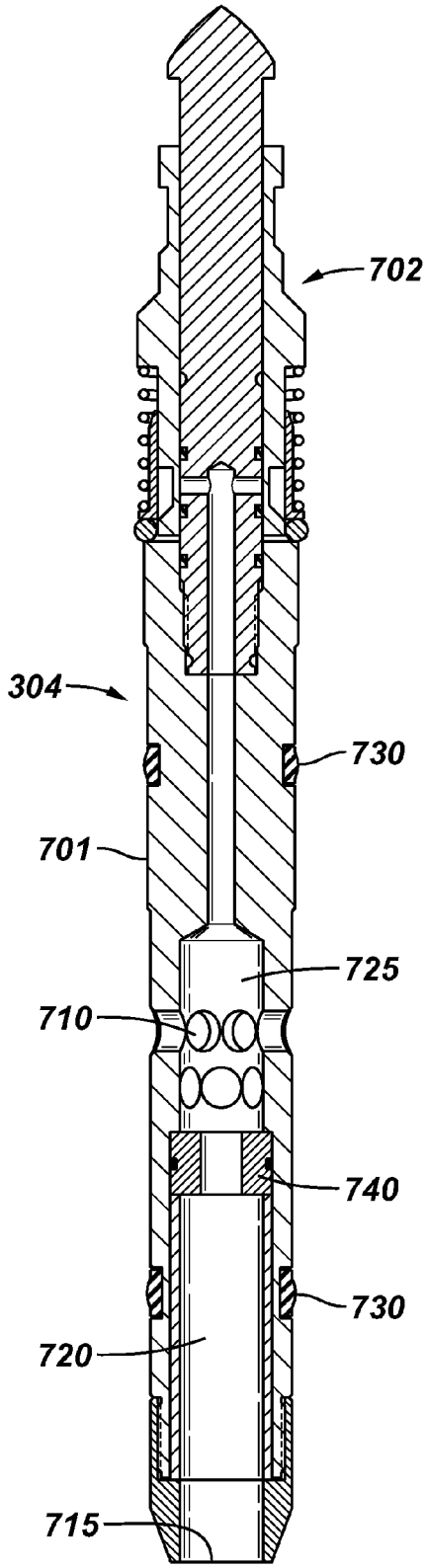
FIG. 7 shows a cross section of portion of an embodiment.

FIG. 7 shows an embodiment of the flow-restrictor 304.

The flow-restrictor 304 has a body 701 that defines therein an upper inner chamber 725 and a lower inner chamber 720. The upper inner chamber 725 and the lower inner chamber 720 are divided by a flow-restriction orifice 740. The flow-restriction orifice 740 and the body 701 can be the same part, or two separate parts fit together. Preferably the flow-restriction orifice 740 has a narrower diameter in a longitudinal axial direction than either the upper inner chamber 725 or the lower inner chamber 720. However, the diameter of the flow-restriction orifice 740 can be essentially the same diameter of either the upper inner chamber 725 or the lower inner chamber 720. Passages 710 are located in the body 701 and hydraulically connect the upper inner chamber 725 with an outside of the flow-restrictor 304. Passage 715 is on the downhole end of the flow-restrictor 304. When the flow-restrictor 304 is in position in the flow-restrictor pocket 610, the passages 710 allow fluid to pass from the water passage 630, though the passages 710 and into the upper inner chamber 725. The fluid then flows through the restrictor orifice 740, into the lower inner chamber 720 and out of the flow-restrictor 304 for re-injection. It should be noted that the flow-restrictor 304 can have many internal configurations, so long as the flow is adequately restricted/throttled.

The flow-restrictor 304 has an attachment part 702 that is used to connect to a downhole tool (not shown) to place and remove the flow-restrictor 304 from the flow-restrictor pocket 610. As noted earlier, the downhole tool can be connected to any relay apparatus, e.g., wireline, slickline, or coiled tubing.

There are many ways to determine an oil/water content of a well fluid. Well fluid can be delivered to surface where a determination can be made. Alternately, a sensor can be located downhole to determine the oil/water ratio in the well fluid. That determination can be transmitted uphole in many ways, e.g., electrical signals over a wire, fiber-optic signals, radio signals, acoustic signals, etc. Alternately, the signals can be sent to a processor downhole, the processor instructing a motor to set a certain orifice size for the flow-restrictor 304 based on those signals. The sensor can be located downstream from the well fluid intake of the oil/water separator, inside the oil/water separator, inside the redirector, inside the flow-restrictor, upstream of the oil/water separator, outside the downhole device and downhole of the well fluid intake, outside the downhole device and uphole of the well fluid intake, or outside the downhole device and at the level of the well fluid intake.

Figure 8:
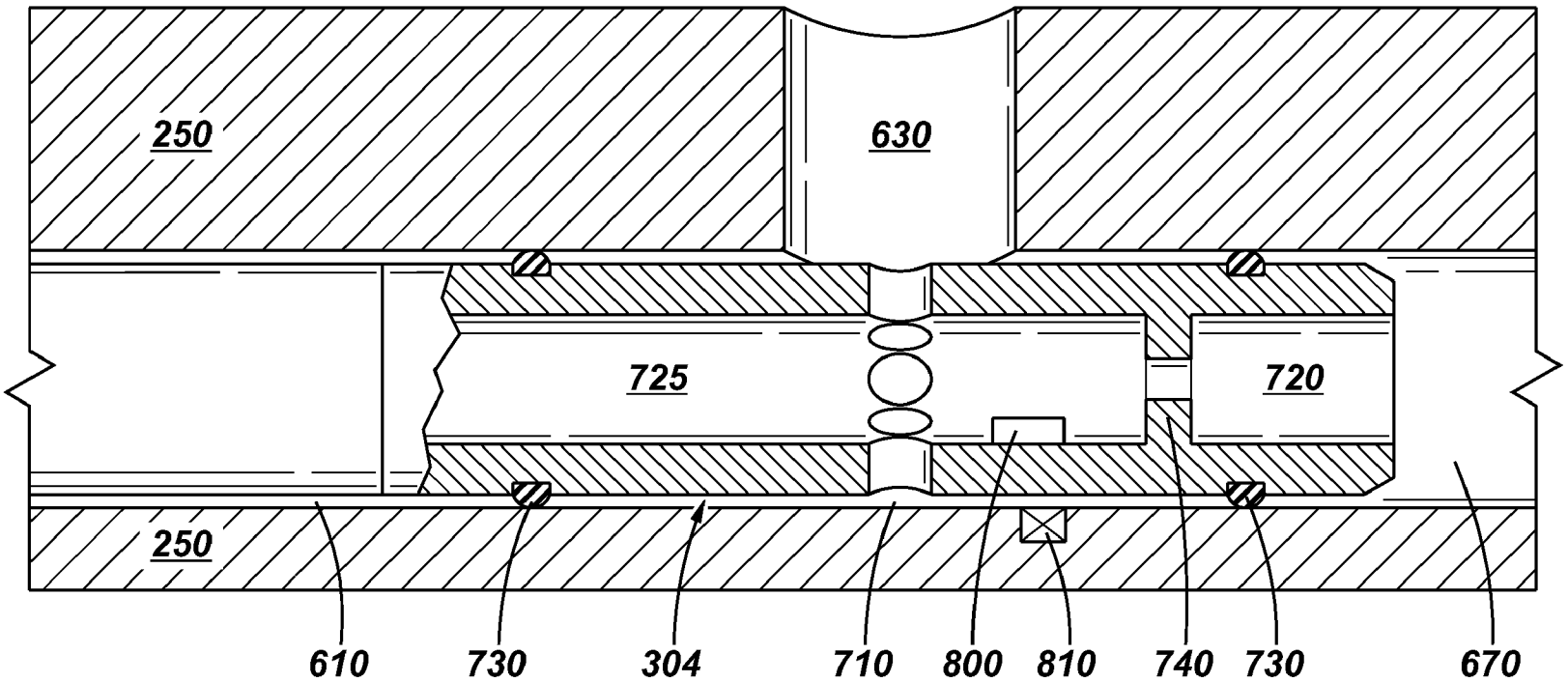
FIG. 8 shows a cross section of a portion of an embodiment.

One embodiment shown in FIG. 8 has a flow-restrictor 304 having a sensor 800 located in the upper inner chamber 725. The sensor could be in the lower inner chamber 720. The sensor 800 can sense temperature, flow rate, pressure, viscosity, or oil/water ratio. The sensor 800 can communicate by way of a telemetry pickup 810 that is integrated with the redirector 250. The sensor 800 can communicate through an electrical contact or "short-hop" telemetry with a data gathering system (not shown).

The preceding description refers to certain embodiments and is not meant to limit the scope of the invention.

What is claimed is:

1. A downhole device comprising:

a downhole end configured for fluid communication with an oil/water separator;

an oil stream conduit and a water stream conduit;

an uphole end defined by a redirector that comprises an uphole conduit configured for fluid communication with the oil stream conduit and the water stream conduit, the oil stream conduit and the water stream conduit disposed substantially in parallel between the downhole end and the uphole end, the oil stream conduit having an axis offset from an axis of the uphole conduit; and a removable flow-restrictor locatable in the water stream conduit and removable from the water stream conduit by a downhole tool relayed via the uphole conduit.

2. The downhole device of claim 1, wherein the removable flow-restrictor has a fixed throttle orifice and the orifice size in the downhole device is changed by interchanging flow-restrictors.

3. The downhole device of claim 1, wherein the removable flow-restrictor has a removable throttle orifice and the orifice size in the downhole device is changed by interchanging throttle orifices.

4. The downhole device of claim 1, further comprising a pump and wherein the water stream conduit opens up into a wellbore at a point farther downhole than the pump.

5. The downhole device of claim 1, wherein the removable flow-restrictor is removable by the downhole tool relayed by at least one member selected from a group consisting of a wireline, a slickline and a coil tubing.

6. The downhole device of claim 1, further comprising the oil/water separator wherein the oil/water separator is a cyclone oil/water separator.

7. The downhole device of claim 1, further comprising the oil/water separator wherein the oil/water separator is a centrifugal oil/water separator.

8. The downhole device of claim 1, comprising a sensor that senses at least one member selected from a group consisting of viscosity, temperature, pressure, flow rate, and oil/water content.

9. The downhole device of claim 8, wherein the sensor location comprises a location selected from a group consisting of downstream from a well fluid intake of an oil/water separator, inside an oil/water separator, upstream of an oil/water separator, outside the downhole device and downhole of a well fluid intake, outside the downhole device and uphole of a well fluid intake, and outside the downhole device and at the level of a well fluid intake.

10. The downhole device of claim 1, wherein the removable flow-restrictor has a throttle part with a variable inside diameter.

11. The downhole device of claim 10, wherein the inside diameter of the throttle part is mechanically variable by the downhole tool relayed on at least one member selected from a group consisting of a wireline, a slickline and a coiled tubing.

12. The downhole device of claim 1 configured with the flow-restrictor in the water stream conduit and to communicate oil received from an oil/water separator via the uphole conduit.

13. The downhole device of claim 1 configured with the flow-restrictor in the water stream conduit and to communicate water received from an oil/water separator in a downhole direction.

14. The downhole device of claim 1 further comprising a check valve disposed in the water stream conduit and a check valve disposed in the oil stream conduit.

15. The downhole device of claim 1 wherein an axis of the water stream conduit and the axis of the uphole conduit are aligned along a common longitudinal axis at the uphole end.

16. The downhole device of claim 1 wherein the downhole end comprises an opening configured for communication with coaxial conduits extending from an oil/water separator.

17. The downhole device of claim 16 wherein an annular conduit of the coaxial conduits comprises a water conduit and wherein a central conduit of the coaxial conduits comprises an oil conduit.

* * * * *